US008640389B2

(12) United States Patent
Battenfield

(10) Patent No.: US 8,640,389 B2
(45) Date of Patent: Feb. 4, 2014

(54) INDOOR SECURITY BARRICADE

(76) Inventor: Jeremy D. Battenfield, Bristow, VA (US)

( * ) Notice: Subject to any disclaimer, the term of this patent is extended or adjusted under 35 U.S.C. 154(b) by 358 days.

(21) Appl. No.: 13/101,291

(22) Filed: May 5, 2011

(65) Prior Publication Data

US 2012/0279134 A1 Nov. 8, 2012

(51) Int. Cl.
*E04B 7/18* (2006.01)

(52) U.S. Cl.
USPC ..... 52/19

(58) Field of Classification Search
USPC ..... 52/19, 261, 270, 183–186, 64; 49/33, 49/50, 131, 325, 357
See application file for complete search history.

(56) References Cited

U.S. PATENT DOCUMENTS

| | | | | | |
|---|---|---|---|---|---|
| 203,343 | A * | 5/1878 | Jackson | 49/367 |
| 270,635 | A * | 1/1883 | Castor | 49/379 |
| 951,280 | A * | 3/1910 | Jones | 49/208 |
| 1,098,957 | A * | 6/1914 | Moffitt | 160/88 |
| 1,715,903 | A * | 6/1929 | Dame | 49/50 |
| 1,759,207 | A * | 5/1930 | Rose et al. | 49/132 |
| 2,137,751 | A * | 11/1938 | Davis | 52/19 |
| 2,174,989 | A * | 10/1939 | Lyons | 49/367 |
| 2,200,727 | A * | 5/1940 | Swenson | 49/73.1 |
| 2,257,791 | A * | 10/1941 | Edmister | 16/290 |
| 2,582,540 | A * | 1/1952 | Gruse | 49/367 |
| 3,100,915 | A * | 8/1963 | Pennington et al. | 52/64 |
| 3,419,999 | A * | 1/1969 | Scheafbauer | 49/33 |
| 3,665,661 | A * | 5/1972 | Beckerer | 52/19 |
| 4,412,404 | A * | 11/1983 | Manning | 52/19 |
| 4,532,915 | A * | 8/1985 | de Rham | 126/242 |
| 4,832,153 | A * | 5/1989 | Daw et al. | 182/46 |
| 5,018,322 | A * | 5/1991 | Fujita | 52/7 |
| 5,134,815 | A | 8/1992 | Pickett | |
| 5,487,237 | A | 1/1996 | Martin, Jr. | |
| 5,735,086 | A * | 4/1998 | Fordahl | 52/19 |
| 5,788,406 | A * | 8/1998 | Hernandez | 404/25 |
| 5,953,866 | A * | 9/1999 | Poole | 52/169.6 |
| 6,438,906 | B1 | 8/2002 | Komarowski et al. | |
| 6,463,702 | B1 | 10/2002 | Weaver et al. | |
| 6,739,100 | B1 | 5/2004 | Lewandowski | |
| 7,458,305 | B1 | 12/2008 | Hollander et al. | |
| 7,690,165 | B2 * | 4/2010 | Taylor | 52/406.1 |
| 8,166,706 | B2 * | 5/2012 | Slimak et al. | 49/386 |
| 2006/0254166 | A1 | 11/2006 | Michels et al. | |
| 2009/0293420 | A1 | 12/2009 | Smith et al. | |
| 2010/0199578 | A1 * | 8/2010 | Checketts | 52/202 |

* cited by examiner

*Primary Examiner* — Mark Wendell
*Assistant Examiner* — Keith Minter
(74) *Attorney, Agent, or Firm* — Michael L. Greenberg, Esq.; Greenberg & Lieberman, LLC

(57) ABSTRACT

An indoor security barricade designed to create a temporary blockade between a home's inhabitants and any intruders. The indoor security barricade can be deployed either by manual or mechanical means and then locked into position during periods of danger or increased vulnerability. It can also be used in offices, schools, or government buildings in order to isolate active shooters or other hostile intruders. The security barricade is envisioned as a hallway barricade, entrance barricade, and stairwell barricade, although other embodiments may also be possible.

9 Claims, 2 Drawing Sheets

INDOOR SECURITY BARRICADE

BACKGROUND OF THE PRESENT INVENTION

Everyone is aware of the dangers associated with living in today's society. Every night many homes are broken into. Criminals are not always looking for items to steal, in fact, they often times enter a home to cause harm to the occupants. A recent case that was publicized extensively in the media reminds us of the types of violent predators that exist. Dr. William Petit Jr. and his family resided in Connecticut when their home was burglarized. Two men claimed that they had entered the house only to steal some items. However, once they were inside the home, they committed some of the most heinous crimes imaginable. They beat Dr. Petit with a baseball bat until he was nearly dead. They killed his 17 year old daughter. Then they raped his wife and 11 year old daughter before dousing them with gasoline and setting them on fire. It is necessary to make security devices available to families so that they can be protected from intruders. This need is filled by the present invention.

The present invention is an indoor security barricade designed to create a temporary blockade between a home's occupants and any intruders. Using conventional technology, the present invention can quickly seal off a portion of a home during periods of danger or increased vulnerability, such as when occupants are asleep. It can also be used in office buildings, schools, courthouses, government buildings, etc., in order to isolate active shooters or other hostile intruders. Within these public places, it can be moved into place by employees, or remotely deployed by security personnel from a control room.

U.S. Pat. No. 6,739,100 is for "Retractable In House Open Stairwell Cover" issued to Lewandowski on May 25, 2004. Lewandowski is a retractable stairwell cover designed to seal a stairwell opening in order to create an environmental divider between "an unconditioned environment in a basement and a conditioned environment on the first floor of a home." Lewandowski differs from the present invention in several respects. Lewandowski explicitly states its purpose as being to provide a barrier between conditioned air and unconditioned air, whereas the present invention's explicit purpose is to provide a security barrier. Furthermore, Lewandowski is intended specifically to create a barrier over a stairwell connecting a first floor to a basement, whereas the present invention is envisioned as a stairwell barricade, an exterior entrance barricade, and a hallway barricade.

U.S. Pat. No. 5,487,237 is for "Security Device for Buildings" issued to Martin, Jr. on Jan. 30, 1996. Martin, Jr. is a conventional security barricade for blocking a doorway or window opening of a building structure. Unlike the present invention, Martin Jr. is a conventional metalwork barricade, and cannot be lowered into place by electrical or manual means in order to seal off specific areas of a home.

U.S. Pat. No. 5,134,815 is for "Barrier Structure" issued to Pickett on Aug. 4, 1992. Pickett is a barrier structure disposed to extend generally along a fence line. Unlike the present invention, Pickett is designed as an outdoor security fence, whereas the present invention is an indoor security barricade.

U.S. Pat. No. 6,463,702, for "Concrete Safe Room" issued to Weaver et al. on Oct. 15, 2002, is a system for forming a safe room that includes a plurality of preformed concrete wall panels and a roof panel, and is intended as a safe haven during a weather storm. U.S. Pat. No. 6,438,906, for "Safe Room" issued to Komarowski et al. on Aug. 27, 2002, is designed for protecting an occupant of a home against tornado and/or strong winds. Unlike the present invention, Weaver et al. and Komarowski et al. are designed to protect one or more occupants of a home from extreme weather conditions, and are not designed to protect from home invaders or other criminals.

U.S. Pat. No. 7,458,305, for "Modular Safe Room" issued to Hollander et al. on Dec. 2, 2008, and U.S. Pub. No. 2009/0293420 for "Ballistic and Forced Entry Resistant Construction" by Smith et al. published on Dec. 3, 2009, are for safe rooms made of panels of ballistic resistant material in order to provide a bullet-resistant room for personnel in times of danger. Unlike the present invention, both Hollander et al. and Smith et al. require the construction of a separate safe room in order to provide security from criminals, whereas the present invention does not require adding a room to a home.

U.S. Pub. No. 2006/0254166 is for "Customizable Saferoom and Method for Making Same" issued to Michels et al. on Nov. 16, 2006. Michels et al. is for a safe room made of multiple panels, endwalls and sidewalls. Unlike the present invention, Michels et al. requires walling off an area such as a crawlspace in order to construct a safe haven, whereas the present invention creates a safe zone by means of a barricade that blocks immediate access to a portion of a home.

SUMMARY OF THE PRESENT INVENTION

The present invention is a home security barricade that deploys to seal off part of a home from intruders. The barrier portion of the present invention is designed to be placed in an unobtrusive position during periods of low vulnerability, and deployed during periods of increased vulnerability such as when the occupants of a home are asleep. The present invention can also be used in office buildings, schools, courthouses, and government buildings in order to isolate active shooters or other hostile intruders. Within these public places, the barrier portion of the present invention can be moved into place by employees or remotely deployed by security personnel from a control room.

The construction of the barrier is accomplished as follows. A sales representative takes measurements of the location where the present invention is to be installed. These measurements are used to shape the barrier so that it can be deployed into position without striking a handrail, doorknob, or other object. The measurements are then forwarded to a supplier of impact resistant material who custom shapes the barrier and places it in a heavy duty frame made of metal or other material of comparable durability. A decorative image selected by the customer is then applied to the barrier, the decorative image being a photograph, canvas painting, or other type of graphic design. Thus the barrier consists of impact resistant material placed in a heavy duty frame with a decorative image applied to it.

The installation of the present invention may require a building contractor and an electrician, depending on the type of mechanism used to deploy the device. If an electrical mechanism is chosen by the user, then an electrician can ensure that an electric winch is plugged into an electrical outlet with a dedicated circuit breaker. The building contractor can ensure the electric winch is mounted to wall studs or ceiling joists in accordance with local building codes. The barrier can then be placed into position, attached to the wall studs or ceiling joists by means of one or more heavy-duty hinges, with a heavy-duty cable attached to both the electric winch and the barrier. Once these steps are complete, the present invention is ready for use.

The preferred embodiment of the present invention is a stairwell barricade. In this embodiment, the barrier is attached to a wall adjacent to a stairwell opening. It attaches to wall joists by means of one or more heavy duty hinges, and locks in place against the wall when inactive. The barrier is deployed when the user lowers it over the stairwell opening and locks it in place by means of a conventional locking mechanism. This embodiment is illustrated in the figures below.

Another embodiment of the present invention is an exterior entrance barricade. In this embodiment, the barrier is placed near an exterior entrance and attached to ceiling joists near the entrance by means of one or more heavy-duty hinges. The barrier is pulled up to the ceiling when inactive, and when activated the barrier lowers in order to block the exterior entrance. Once it is lowered into position so that it blocks the exterior entrance, the user then locks the barrier into position by means of a conventional locking mechanism.

Yet another embodiment of the present invention is a hallway barricade. In this embodiment, the barrier is attached to a wall adjacent to a hallway opening. The barrier is attached to wall joists by means of one or more heavy-duty hinges, and is deployed when the user moves the barrier over the hallway opening and locks it in place by means of a conventional locking mechanism.

FIGURES ILLUSTRATING THE PRESENT INVENTION

DETAILED DESCRIPTION OF THE PRESENT INVENTION

The present invention is an indoor security barricade comprised of numerous parts, chief among them the barrier (10) itself. The barrier (10) is made of impact resistant material placed into a heavy duty frame and imprinted with a decorative image such as a photograph, canvas painting, or other type of graphic design. The impact resistant material can be steel plate or marble, although the preferred embodiment is material of a lighter weight yet still impact resistant, such as high density polyurethane. In order to make the barrier (10) fit the place of installation, detailed measurements are taken and forwarded to a supplier who custom cuts the impact resistant material. Once the impact resistant material has been shaped, it is placed into the heavy duty frame and the decorative image is applied. The resulting barrier (10) is then installed in the customer's home, office or other locale, along with conventional equipment that includes a heavy-duty cable (50), a heavy-duty hinge (15), and other conventional mounting hardware. In the preferred embodiment of the present invention, a heavy-duty piano hinge is used as the hinge (15).

Figure 1:
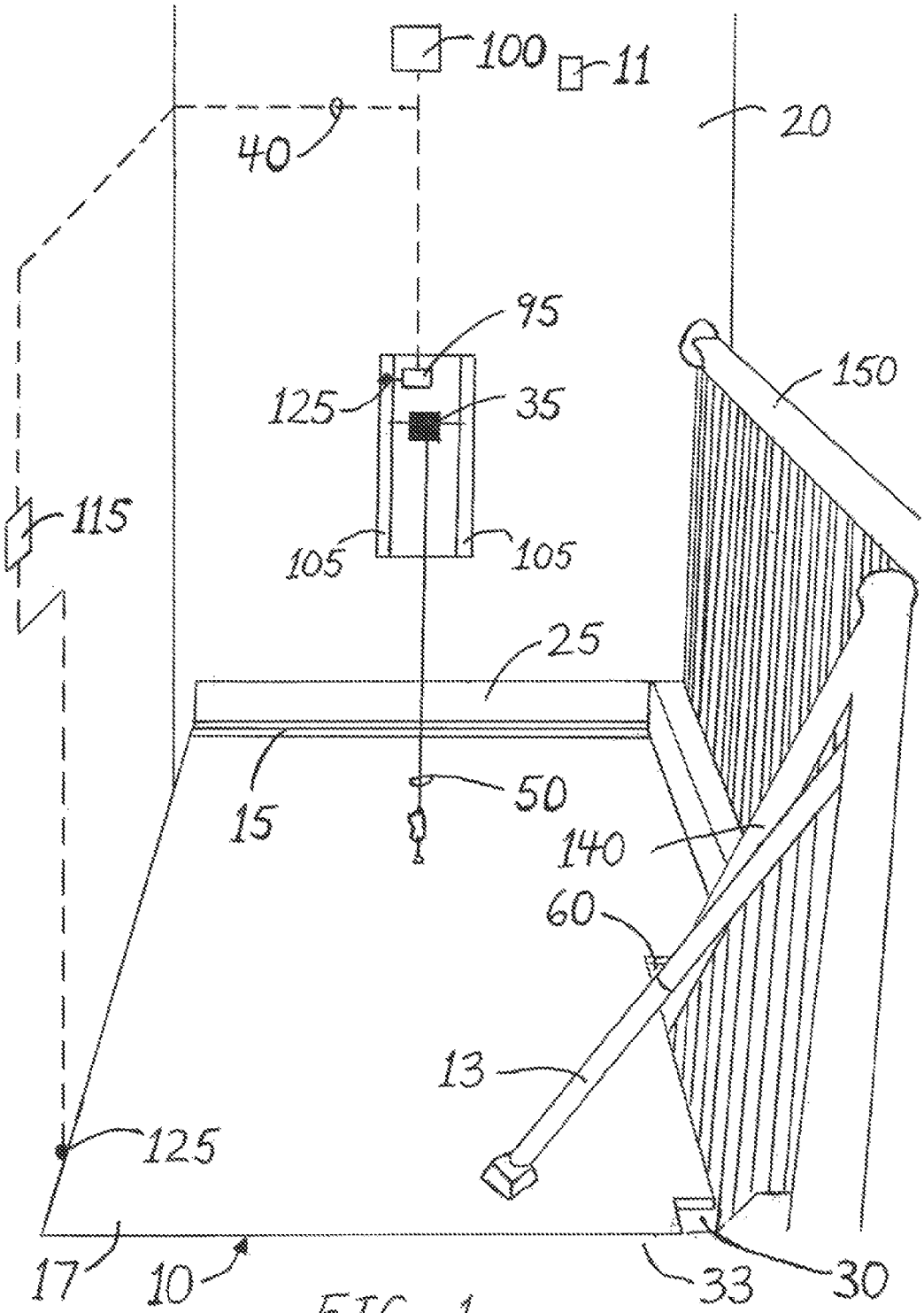
FIG. 1 shows the preferred embodiment of the present invention, as an electrically deployable stairwell barricade, with the barrier (10) in a lowered position.

FIG. 1 shows the preferred embodiment of the present invention, as an electrically deployable stairwell barricade, with the barrier (10) in a lowered position. In the lowered position depicted in FIG. 1, the second side (17) of the barrier (10) is facing upward, and facing downward is the barrier's first side (16) (not shown in FIG. 1, see FIG. 2). The barrier (10) lowers into position by means of the cable (50) and the conventional electric winch (35), and is shown adjacent to the stairwell railing (150) and covering the stairwell (30) (not visible in FIG. 1, see FIG. 2). The electric winch (35), which requires an electrical outlet (95) with a dedicated circuit breaker is mounted to wall studs (105). The electric winch (35) is connected by electrical wiring (40) to a remote switch (115) mounted on the wall (20) and to conventional limit switches (125) placed on the wall (20) and wall studs (105). (The electrical wiring (40) used for the present invention is represented in FIG. 1 by dashed lines.) A conventional board (25) is nailed into the wall studs (105) (only two of which are seen in FIG. 1), and the barrier (10) attaches to the board (25) by means of the hinge (15). When the electric winch (35) is activated by the switch (115), the barrier (10) raises until it engages the limit switch (125) mounted on a wall stud (105), or lowers until it engages the limit switch (125) mounted at the level of the landing (33) of the stairwell (30). Once the barrier (10) is in the raised position (see FIG. 2), it is secured in place by a first locking mechanism (11), which is a conventional slide bolt lock. Once the barrier (10) is in the lowered position, it is secured in place by a second locking mechanism (13). The second locking mechanism (13) shown in FIG. 1 is a conventional door brace that is braced between the barrier's second side (17) and the handrail (140). Also shown in FIG. 1 is the gap (60) placed in the barrier (10) so that the handrail (140) does not prevent the barrier (10) from lowering fully.

Figure 2:
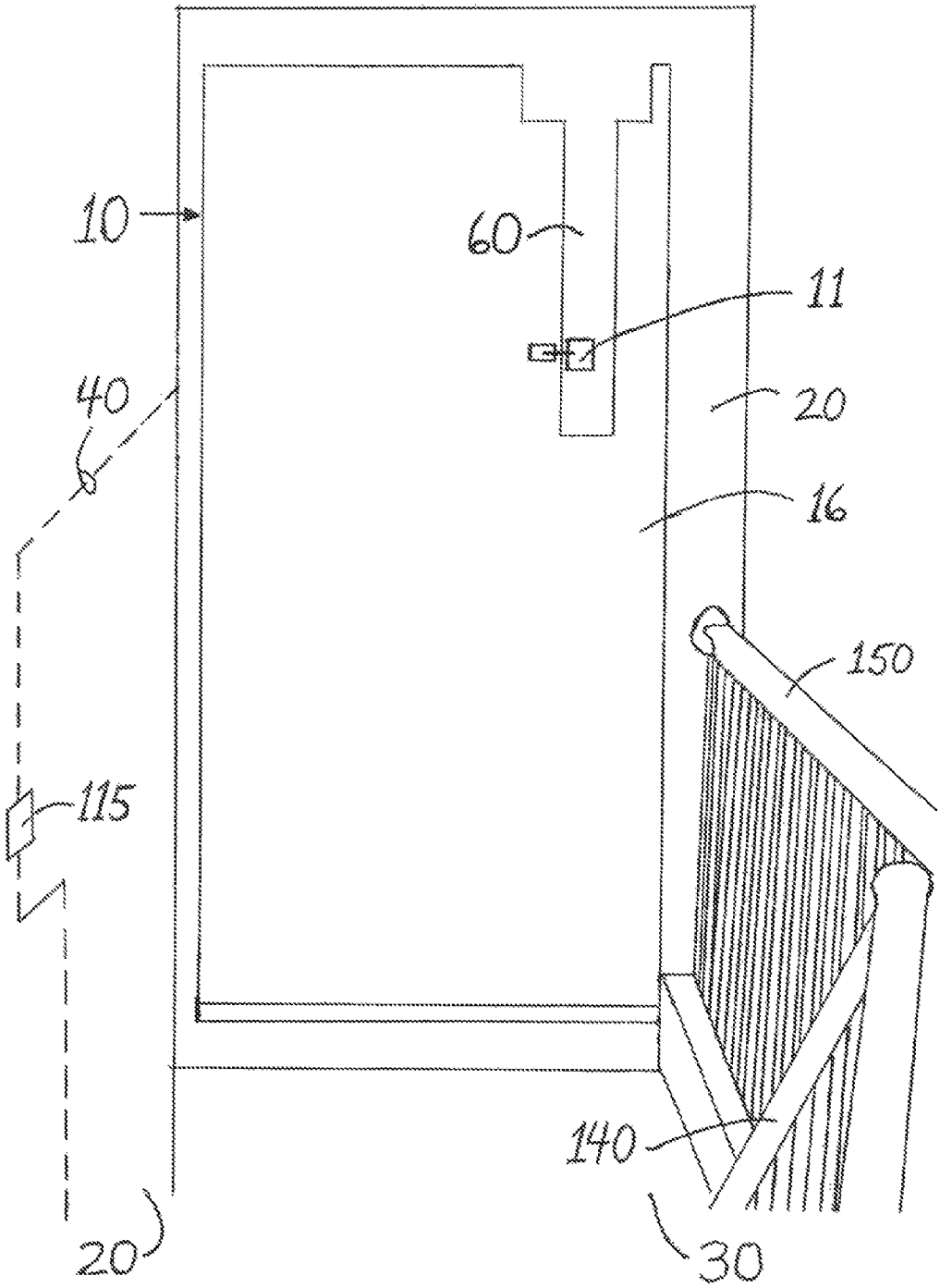
FIG. 2 shows the preferred embodiment of the present invention, as an electrically deployable stairwell barricade, with the barrier (10) in a raised position.

FIG. 2 shows the preferred embodiment of the present invention, as an electrically deployable stairwell barricade, with the barrier (10) in a raised position. In the raised position depicted in FIG. 2, the first side (16) of the barrier (10) is facing outward, and facing the wall (20) is the barrier's second side (17) (not shown in FIG. 2, see FIG. 1).T*he* barrier (10), by means of the first locking mechanism (11), is locked into the raised position against the wall (20) over the stairwell (30) and adjacent to the stairwell railing (150). Once the barrier (10) is in the raised position, it can be secured in place by the first locking mechanism (11). Also shown is the electrical wiring (40), represented by dashed lines, and the switch (115) that activates the electric winch (35) (not shown in FIG. 2, see FIG. 1) that raises and lowers the barrier (10) by means of the cable (50) (not shown in FIG. 2, see FIG. 1). Also shown in FIG. 2 is the gap (60) placed in the barrier (10) so that the handrail (140) does not prevent the barrier (10) from lowering fully.

Alternate embodiments of the present invention, not represented in figures, are described below. One alternate embodiment is also a stairwell barricade, although it is manually deployed, employing a conventional spring and cable system. The spring and cable system, similar to the type used to reduce the amount of force needed to raise trailer gates, is installed in the wall (20) behind the barrier (10), bolted to a wall stud (105), with its cable (50) attached to the barrier (10). As force is applied to the barrier (10) in order to lower or raise it, the cable (50) extends or retracts, allowing the barrier (10) to move up or down on its one or more hinges (15). When force is not being applied, the barrier (10) stops moving. The spring and cable system does not allow the barrier (10) to fall to the stairwell (30) or slam closed against the wall (20), but stops the barrier (10) in place whenever pressure is not being applied to raise or lower it. Once the barrier (10) is fully deployed or fully raised, conventional locking mechanisms are used to secure it in place.

Another embodiment of the present invention that is not illustrated in the figures is an exterior entrance barricade. In this embodiment, the barrier (10) is placed near an exterior entrance and attached to ceiling joists near the entrance by means of one or more hinges (15). The barrier (10) is pulled up to the ceiling when inactive, and deploys either electrically or manually so that the barrier is suspended by both a cable (50) and one or more hinges (15) in order to block the exterior entrance. Once the barrier (10) is lowered into position so that it blocks the exterior entrance, the user then locks the barrier (10) into position by means of a conventional locking mechanism.

Yet another envisioned embodiment of the present invention is a hallway barricade. In this embodiment, the barrier (10) is attached to a wall adjacent to a hallway opening. The barrier (10) locks in place against the wall when inactive and is attached to wall studs (105) by means of one or more hinges (15). The barrier (10) is deployed by moving it over the hallway opening and locking it in place by means of a conventional locking mechanism.

In summary, the present invention is a security barricade, comprising a barrier (10), the barrier (10) configured to lower over a stairwell (30) to meet the plane of a landing (33) at the top of the stairwell (30); a first side (16) of the barrier (10), the first side (16) facing downward toward the stairwell (30); a second side (17) of the barrier (10), the second side (17) facing upward away from the stairwell (30); a first locking mechanism (11) disposed on the first side of the barrier (10); a second locking mechanism (13) disposed on the second side of the barrier (10); wherein the barrier (10) has a gap (60) configured to allow the barrier (10) to lower around a handrail (140) of the stairwell (30); wherein the first side (16) of the barrier (10) is configured to prevent opening of the barrier (10); wherein the barrier (10) is configured to raise away from the stairwell (30) and to rest against a wall (20); further comprising a cable (50) between the barrier (10) and the wall (20); and further comprising a switch (115) in communication with the barrier (10), the switch (115) configured to raise and lower the barrier (10).

The present invention should not be taken as limited to the above embodiments, as its concept may also take the form of additional embodiments not explicated in this document.

The invention claimed is:

1. A security barricade, comprising:

a barrier, said barrier configured to lower over a stairwell to meet the plane of a landing at the top of the stairwell;

a first side of said barrier, said first side facing downward toward the stairwell;

a second side of said barrier, said second side facing upward away from the stairwell;

wherein said barrier has a gap, which is a cut in said barrier, configured to allow said barrier to lower around a handrail of said stairwell;

a mechanism configured to open and close said barrier, said mechanism disposed above said barrier;

wherein said mechanism is configured to hold said barrier closed in a horizontal position;

a first locking mechanism disposed on said first side of said barrier; and a second locking mechanism disposed on said second side of said barrier.

2. The security barricade of claim 1, wherein said first side of said barrier is configured to prevent opening of said barrier.

3. The security barricade of claim 1, wherein said barrier is configured to raise away from said stairwell.

4. The security barricade of claim 1, wherein said barrier is configured to raise away from said stairwell and to rest against a wall.

5. The security barricade of claim 1, further comprising a cable between said barrier and a wall.

6. The security barricade of claim 4, further comprising a cable between said barrier and said wall.

7. The security barricade of claim 1, further comprising a switch in communication with said barrier.

8. The security barricade of claim 1, further comprising a switch in communication with said barrier, said switch configured to raise and lower said barrier.

9. A security barricade, comprising:

a barrier, said barrier configured to lower over a stairwell to meet the plane of a landing at the top of the stairwell;

a first side of said barrier, said first side facing downward toward the stairwell;

a second side of said barrier, said second side facing upward away from the stairwell;

wherein said barrier has a gap which is a cut in said barrier;

a first locking mechanism disposed on said first side of said barrier;

a second locking mechanism disposed on said second side of said barrier;

wherein said first side of said barrier is configured to prevent opening of said barrier;

wherein said barrier is configured to raise away from said stairwell and to rest against a wall;

further comprising a cable between said barrier and said wall; and further comprising a switch in communication with said barrier, said switch configured to raise and lower said barrier.

* * * * *